United States Patent [19]

Hillman et al.

[11] 4,109,337

[45] Aug. 29, 1978

[54] AUTOMATED TWO-SIDED CLEANING APPARATUS

[75] Inventors: Gary Hillman, Livingston; Michael Devico, Chatham, both of N.J.

[73] Assignee: Machine Technology, Inc., East Hanover, N.J.

[21] Appl. No.: 858,517

[22] Filed: Dec. 8, 1977

[51] Int. Cl.[2] ..... A46B 13/04

[52] U.S. Cl. ..... 15/21 D; 15/77

[58] Field of Search ..... 15/21 R, 21 B, 21 C, 15/21 D, 21 E, 77, 102; 134/6, 9

[56] References Cited

U.S. PATENT DOCUMENTS

| | | | |
|---|---|---|---|
| 3,585,668 | 6/1971 | Jaccodine et al. | 15/21 D |
| 3,748,677 | 7/1973 | Frank et al. | 15/21 D |
| 3,939,514 | 2/1976 | Cook | 15/21 C |
| 4,062,463 | 12/1977 | Hillman et al. | 15/21 E X |

*Primary Examiner*—Edward L. Roberts

*Attorney, Agent, or Firm*—Lerner, David, Littenberg & Samuel

[57] ABSTRACT

Apparatus is disclosed for automatically and simultaneously cleaning both sides of a plurality of workpieces. The workpieces are illustratively thin, fragile slices of brittle material, such as single-crystal silicon wafers. These workpieces are supplied to the cleaning apparatus within a cassette. The cleaning apparatus includes a cassette receiving station, a processing station and guide means extending from the cassette receiving station through the processing station. The guide means is adapted to receive edge portions of the workpieces. A transfer arm is extended from a retracted position through the cassette so that a first portion of the transfer arm pushes a workpiece along the guide means through the processing station. The transfer arm is then retracted and a second portion of the transfer arm pushes the workpiece along the guide means back through the processing station and into the cassette. The cassette is then moved so that the next workpiece to be processed is in position adjacent the guide means. The processing station extends on both sides of the guide means and includes a scrubbing station. In the region of the scrubbing station, the guide means is arranged so that the entire workpiece surface is exposed to the scrubbing station.

14 Claims, 8 Drawing Figures

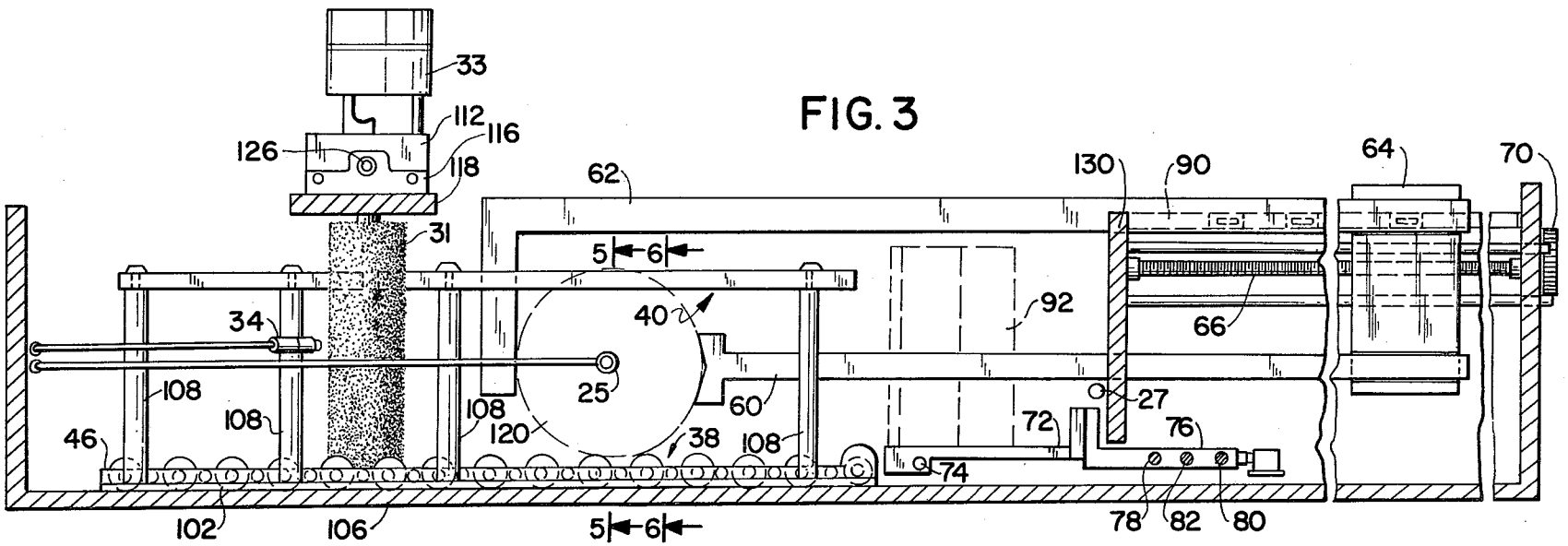
FIG. 3
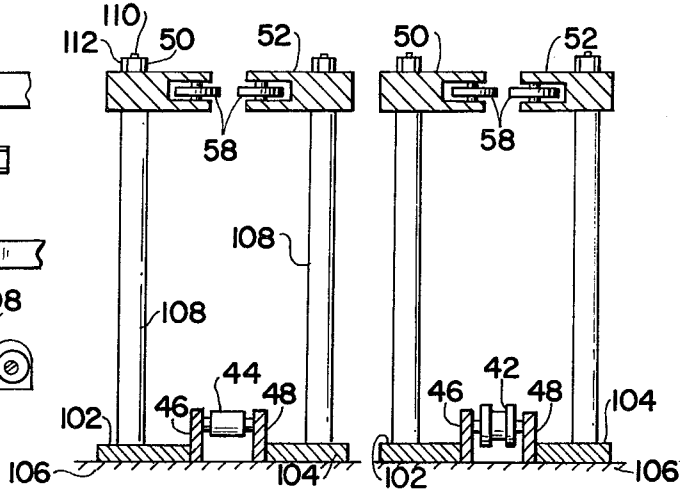
FIG. 6
FIG. 5
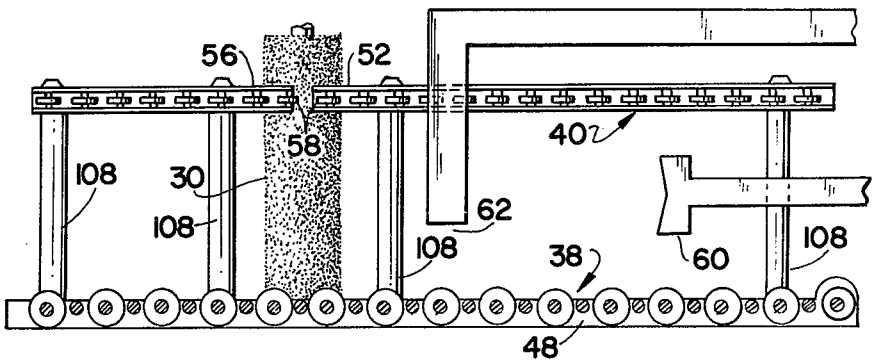
FIG. 4

AUTOMATED TWO-SIDED CLEANING APPARATUS

BACKGROUND OF THE INVENTION

This invention relates to the processing of thin slices of material and, more particularly, to apparatus for automatically removing such slices from a cassette, simultaneously cleaning both sides thereof, and returning the slices to the cassette.

In the processing of semiconductor materials for the ultimate manufacture of integrated circuits and the like, one of the steps required is the cleaning of single-crystal silicon wafers. In years past, such cleaning was performed manually by an operator. An improvement to this manual process is disclosed in U.S. Pat. No. 3,748,677 which discloses semi-automatic apparatus for simultaneously scrubbing both sides of a wafer. The wafers are manually loaded, one at a time, into a rotating disc having pockets formed in the periphery thereof. The disc conveys the wafers between two opposed counter-rotating brushes within a detergent solution spray. After passing the rotating brushes, the wafers drop from the pockets in the disc and float through the detergent bath to a container positioned below the disc. This apparatus possesses a number of disadvantages. In particular, the wafers must be loaded one at a time into the pockets of the disc while other wafers are being scrubbed. Additionally, the wafers are dropped into a bath of the material utilized to clean the wafers, which bath contains impurities just removed from the wafers.

An alternative design in the prior art provides a supply cassette having a plurality of wafers positioned therein. The wafers are removed one at a time from the supply cassette and brought along a series of belts or similar means to a plurality of brushes which scrub both sides of the wafers. The brushes are placed parallel to the direction of movement necessitating rotation of the wafers to enable the entire surface to be scrubbed. The wafers are then conveyed by a series of driven rollers to an air chamber in which the water is blasted off. The wafers are then placed in a second, initially empty, cassette. This is a continuous process with wafers being in various stages of cleaning at any particular time. Unfortunately, this apparatus requires a large amount of space and is very complex in its design. It also requires two cassettes, one being unloaded and the other being loaded.

An improved apparatus is disclosed in our copending application Ser. No. 685,303, filed May 11, 1976, now U.S. Pat. No. 4,062,463, entitled "Automated Single Cassette Load Mechanism for Scrubber" and assigned to the assignee herein, wherein a single cassette is utilized to supply wafers to be cleaned and to receive the wafers after they are cleaned. The apparatus includes a wafer-supporting arm which is movable between a retracted position within the cassette and a scrubbing station for moving a selected one of the silicon wafers from its position within the cassette to the scrubbing station and for returning the selected wafer from the scrubbing station to the cassette. The cassette is located between the retracted position of the arm and the scrubbing station so that the wafer-supporting arm moves from its retracted position to an extended position through the cassette to transfer the selected wafer therefrom and deposit the wafer on a chuck at the scrubbing station. The wafer-supporting arm is then returned to its retracted position while the selected wafer is spun on the chuck and one side of the wafer is cleaned. Then, the wafer-supporting arm is again moved from its retracted position through the cassette to the scrubbing station to receive the cleaned silicon wafer, and is then retracted through the cassette to deposit the cleaned wafer in the cassette. A selection device then operates to move the cassette so that the next wafer to be cleaned is in position to be picked up by the wafer-supporting arm when it is next moved between its retracted position and the scrubbing station. While this apparatus is an improvement in its simplicity over other prior art apparatus, it has the disadvantage that only a single side of the wafer may be cleaned at one time.

It is therefore an object of this invention to provide improved apparatus for automatically and simultaneously cleaning both sides of a silicon wafer.

It is another object of this invention to provide such apparatus wherein only a single cassette is utilized for loading and unloading the wafers to and from a processing station.

SUMMARY OF THE INVENTION

The foregoing and additional objects are attained in accordance with the principles of this invention by providing apparatus for moving a workpiece from within a cassette through a processing station and back to the cassette, the apparatus comprising a frame, the processing station being mounted on the frame, a cassette receiving station mounted on the frame for receiving the cassette, guide means extending from the cassette receiving station through the processing station for receiving an edge portion of the workpiece, and workpiece moving means for moving the workpiece from its position within the cassette along the guide means through the processing station and for moving the workpiece back through the processing station along the guide means to the cassette.

In accordance with an aspect of this invention, the processing station extends on both sides of the guide means.

In accordance with another aspect of this invention, the guide means is arranged so as to expose the entire workpiece within the processing station.

BRIEF DESCRIPTION OF THE DRAWING

The foregoing will be more readily apparent from reading the following description in conjunction with the drawing in which:

FIG. 3 depicts a side view taken along the line 3—3 of FIG. 2;

FIG. 4 depicts a sectional view taken along the line 4—4 of FIG. 2;

FIG. 5 depicts a sectional view taken along the line 5—5 of FIG. 3;

FIG. 6 depicts a sectional view taken along the line 6—6 of FIG. 3;

GENERAL DESCRIPTION OF THE PREFERRED EMBODIMENT

Figure 1:
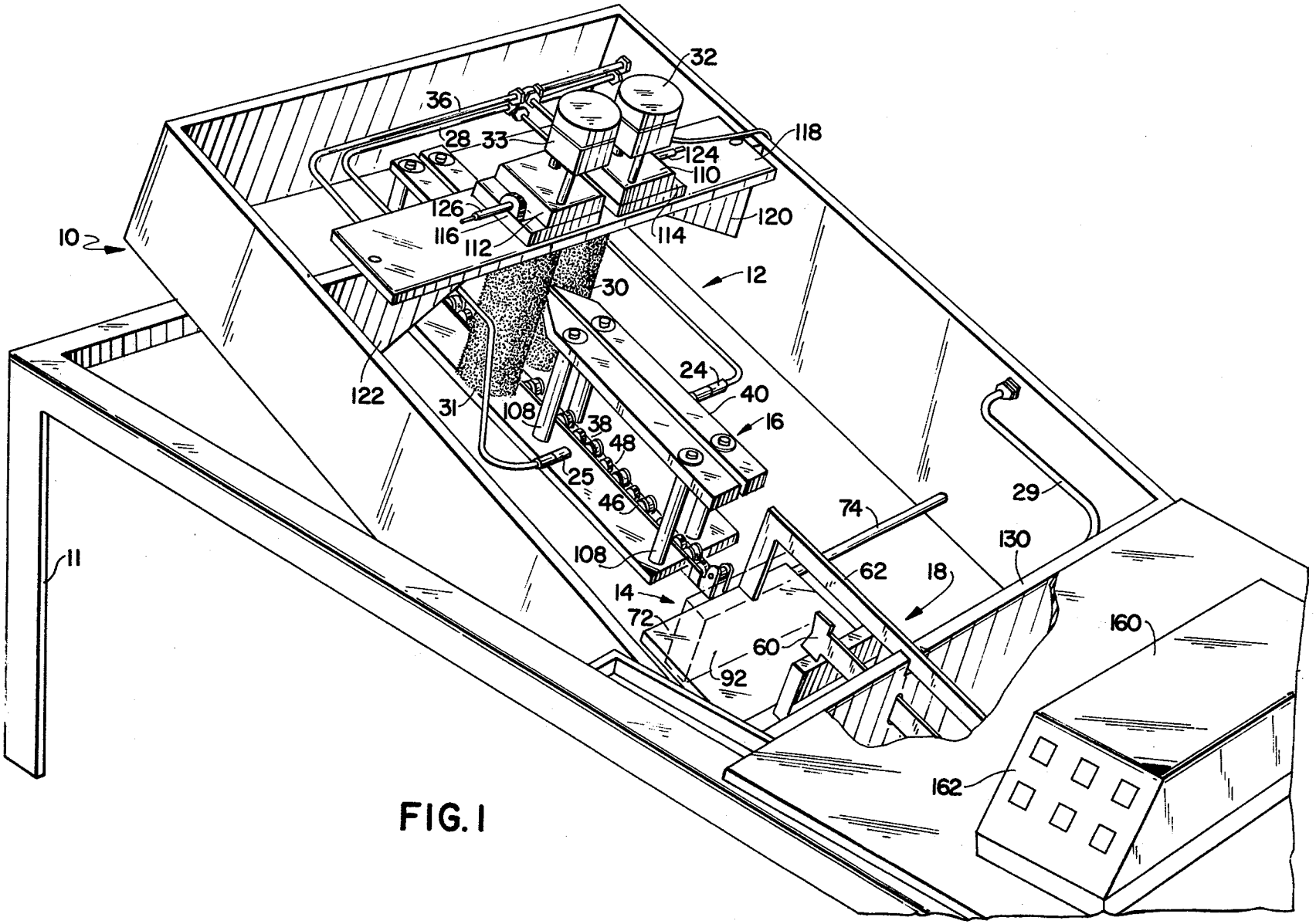
FIG. 1 depicts a perspective view of apparatus constructed in accordance with the principles of this invention.

Referring now to the drawing, wherein like reference numerals in different figures denote like parts, depicted therein is apparatus constructed in accordance with the principles of this invention for simultaneously cleaning both sides of a plurality of workpieces. The apparatus includes a frame, denoted generally by the reference numeral 10, a processing station, denoted generally by the reference numeral 12, mounted on the frame 10, a cassette receiving station, denoted generally by the reference numeral 14, mounted on the frame 10, guide means, denoted generally by the reference numeral 16, extending from cassette receiving station 14 through processing station 12, and workpiece moving means, denoted generally by the reference numeral 18. Frame 10 is supported by suitable support structure 11 and is tilted at an angle, for reasons which will become apparent from the following discussion.

Processing station 12 includes a rinse station 20 and a scrubbing station 22. Rinse station 20 includes water spray nozzles 24, 25, 26 and 27 connected to water lines 28 and 29. Scrubbing station 22 includes a pair of brushes 30 and 31 which are coupled to driving motors 32 and 33, respectively. Scrubbing station 22 further includes a pair of spray nozzles 34 and 35 connected to line 36.

Guide means 16 includes a lower guideway 38 and an upper guideway 40. Lower guideway 38 includes a plurality of rollers which are alternately flanged and unflanged. The central minor diameters of the flanged rollers 42 are equal to the central major diameters of the unflanged rollers 44 so that an essentially flat pathway is provided for moving the workpieces thereon. The rollers 42 and 44 are mounted for free rotation between side supports 46 and 48. Side supports 46 and 48 illustratively have a series of holes bored therethrough for accepting therein the shafts of rollers 42 and 44. These holes are arranged with their centers in linear relationship. The use of flanged rollers is desirable to hold an edge portion of the workpiece. However, if only flanged rollers were utilized, then the spacing between the central portions of adjacent rollers would be excessive. Therefore, unflanged rollers 44 alternate with flanged rollers 42 so as to keep this spacing to a minimum. Alternatively, only unflanged rollers may be used with a continuous guiding surface disposed above the rollers.

Upper guideway 40 includes a first pair of parallel spaced apart members 50 and 52 and a second pair of parallel spaced apart members 54 and 56. The first and second pairs of parallel spaced apart members of upper guideway 40 have a space therebetween in the region of brushes 30 and 32, leaving the workpiece exposed in that region, the reason for which will become apparent from the following discussion. Each of the members 50, 52, 54, and 56 has mounted therein a plurality of rollers 58, as clearly shown in FIGS. 5 and 6. Rollers 58 are mounted for free rotation within the respective members of upper guideway 40, with their axes of rotation being substantially parallel to the plane of the workpiece being guided therebetween.

Workpiece moving means 18 includes a pair of transfer arms 60 and 62. Transfer arm 60 is utilized for pushing a workpiece from within a cassette held by cassette receiving station 14 along guide means 16 through processing station 12 and transfer arm 62 is utilized for pushing the same workpiece along guide means 16 back through processing station 12 and into the cassette. Transfer arms 60 and 62 are mounted for motion together on block 64. Block 64 includes a ball screw (not shown) mounted on threaded shaft 66. Shaft 66 is turned by motor 68 through gearing mechanism 70.

Cassette receiving station 14 includes a platform 72 adapted to receive a cassette (shown in phantom lines) thereon. Platform 72 is adapted to ride on rail 74 secured to frame 10 and is also connected to carriage member 76. Carriage member 76 rides on rails 78 and 80 secured to frame 10. Carriage member 76 also has attached thereto a ball screw which engages threaded shaft 82. Threaded shaft 82 is rotated by motor and gearing mechanism 84 so as to cause platform 72 and carriage member 76 to be moved back and forth along their guide rails 74, 78 and 80 in a controlled manner, as described in more detail hereinafter.

To control the apparatus, there is provided a control system which responds to the actuation of a plurality of limit switches disposed at strategic points within the apparatus. A first group of these limit switches are mounted on bar 86 and are designated LS-1, LS-2 and LS-3. An actuator arm 88 is provided on carriage member 76 so that as carriage member 76 is moved along shaft 82, the limit switches mounted on bar 86 are successively actuated. A second group of limit switches are mounted on bar 90. These limit switches are designated LS-4, LS-5, LS-6 and LS-7. This second group of limit switches is actuated successively by an actuator arm (not shown) mounted on block 64 so that the movement of transfer arms 60 and 62 may be tracked. Another limit switch (not shown) is provided for cooperation with motor and gearing mechanism 84 for controlling the step-wise movement of carriage member 76, as will be described in more detail hereinafter.

DETAILED DESCRIPTION

Cassette Receiving Station

As described above, cassette receiving station 14 includes a platform 72 secured to carriage member 76. The apparatus according to this invention is designed to accept different size workpieces for cleaning. For example, 3 inch diameter circular discs and 1 inch by 2 inch rectangular plates are two common workpiece sizes. These different workpiece sizes utilize different size cassettes. Therefore, cassette receiving station 14, and in particular, platform 72, is designed to accomodate the different size cassettes thereon. In any event, platform 72 includes means (not shown) for releasably securing different size cassettes.

Figure 7:
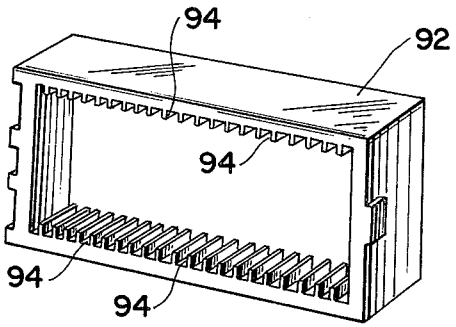
FIG. 7 is a perspective view of an illustrative workpiece cassette for use with the apparatus of this invention.

As shown In FIG. 7, a cassette 92 for holding workpieces includes a plurality of slots formed by walls 94. One end of cassette 92, designated the front end, is open to allow for easy insertion and removal of the workpieces. The other end of the cassette, designated the rear end, is partially open to allow transfer arm 62 to extend therethrough, but is sufficiently closed to prevent movement of the workpieces through the rear end. The size of cassette 92 depends upon the workpiece it is designed to hold, and as such does not form a part of the present invention.

Figure 2:
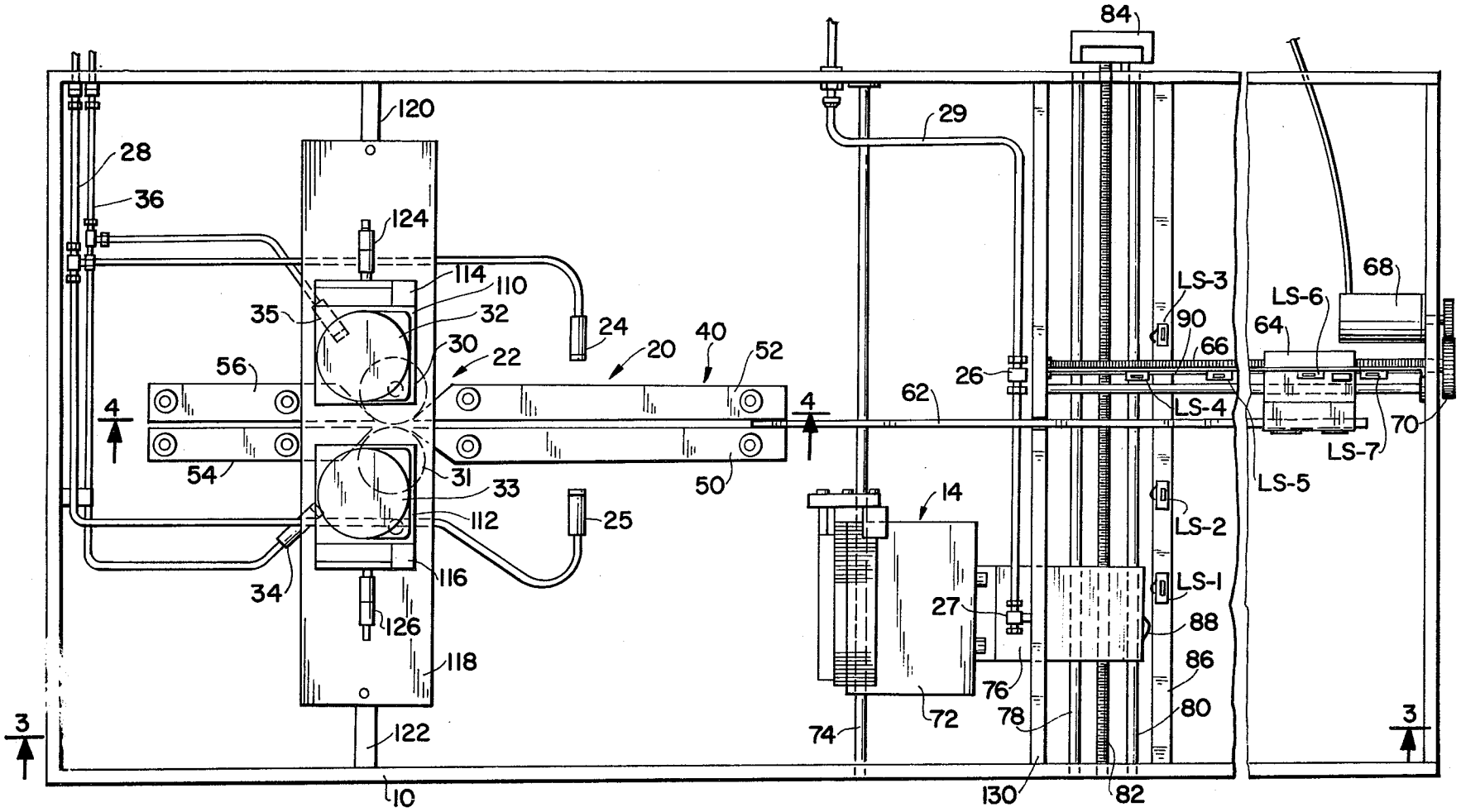
FIG. 2 depicts a plan view of the apparatus shown in FIG. 1.

Platform 72 has a home position, shown in FIG. 2, at which position it is free of all obstructions, such as arms 60 and 62, so that a cassette can be readily removed from or placed on the platform 72. In this position, actuator 88 operates limit switch LS-1. During processing of the workpieces, platform 72 is first moved so that a first end slot is in alignment with guide means 16. In this position, actuator 88 operates limit switch LS-2. After the workpiece in the first cassette slot is processed, platform 72 is moved so that the next slot is in alignment with guide means 16. This intermittent movement of the platform continues until the workpiece in the last cassette slot is processed. At this time, actuator 88 operates limit switch LS-3. Platform 72 is then moved back to its home position so that the cassette may be replaced with a fresh cassette containing new workpieces to be processed.

The movement of platform 72 is effected by means of motor and gearing mechanism 84 which turns threaded shaft 82. The pitch of the threads of shaft 82 are chosen so that a predetermined number of turns of shaft 82 causes platform 72 to be indexed a single cassette slot position. Motor and gearing mechanism 84 therefore include a camming arrangement (not shown) which actuates a limit switch (not shown) whenever shaft 82 has made that predetermined number of turns, so that the shaft motor may be disabled after such time in order to index the movement of platform 72 in fixed increments corresponding to the spacing between cassette slots.

Guide Means

Lower guideway 38 of guide means 16 includes a pair of side supports 46 and 48 which are respectively joined to plate members 102 and 104 in a conventional manner. Plate members 102 and 104 are connected to floor 106 of frame 10, likewise in a conventional manner. Upper guideway 40, comprising members 50, 52, 54 and 56, is supported on plate members 102 and 104 by means of a plurality of posts 108. Each of the posts 108 has a threaded shaft 110 which extends through a hole provided in the members 50–56 of upper guideway 40, these threaded shafts 110 being capped by nuts 112 so as to secure members 50–56. The spacing between lower guideway 38 and upper guideway 40 is determined by the height of posts 108. Since the described apparatus is adapted to process different size workpieces, the spacing between lower guideway 38 and upper guideway 40 may be adjusted to accomodate these different size workpieces by changing the length of posts 108.

The spacing between the opposed members of upper guideway 40 is chosen so that there is sufficient room between opposed rollers 58 to allow arm 62 to move freely therebetween. Rollers 58 are provided so that if the workpiece being conveyed along guide means 16 should lean toward one side or the other, a low friction surface is provided.

It is noted from FIGS. 3 and 4 that upper guideway 40 is discontinuous in a region directly adjacent brushes 30 and 31. Likewise, directly below this discontinuity, lower guideway 38 is arranged with an unflanged roller 44 at that point. The reason for the discontinuity and the placement of an unflanged roller 44 at this point is to allow a workpiece being moved along guide means 16 to be completely exposed at scrubbing station 22. Since guide means 16 guides a workpiece by receiving an edge portion thereof, at all other regions of guide means 16 that edge portion of the workpiece is covered. Therefore, the discontinuity and the unflanged roller are provided in the region of scrubbing station 22 so as to expose the entire workpiece thereat.

Processing Station

Processing station 12 extends on both sides of guide means 16. As was previously mentioned, processing station 12 includes a rinse station 20 and a scrubbing station 22. Rinse station 20 includes water spray nozzles 24 and 25 which spray water on a workpiece as it is moved along guide means 16, both before and after it passes scrubbing station 22. Rinse station 20 also includes a pair of water spray nozzles 26 and 27 which spray water on the workpiece while they are held in cassette receiving station 14.

Scrubbing station 22 includes a pair of reversibly powered brushes 30 and 31 and a pair of spray nozzles 34 and 35. Spray nozzles 34 and 35 are directed at brushes 30 and 31 for spraying either a detergent solution or water thereon as a workpiece moves through scrubbing station 22, as will be described in more detail hereinafter. Brushes 30 and 31 are coupled to respective reversible driving motors 32 and 33. Driving motor 32 is mounted on block 110 and driving motor 33 is mounted on block 112. Blocks 110 and 112 are slidably mounted on respective blocks 114 and 116 which in turn are fixedly secured to plate 118. Plate 118 is attached to frame 10 by brackets 120 and 122. A pair of micrometers 124 and 126 are utilized for sliding blocks 110 and 112 along blocks 114 and 116, respectively. Thus, the spacing between brushes 30 and 31 may be adjusted so that when a workpiece is positioned therebetween the brushes can simultaneously scrub both workpiece surfaces.

Workpiece Moving Means

As described above, workpiece moving means 18 includes a forward transfer arm 60 and a return transfer arm 62. Transfer arms 60 and 62 are mounted on block 64 for longitudinal movement when motor 68 causes threaded shaft 66 to turn. Limit switches LS-4 through LS-7 are successively actuated as block 64 moves along shaft 66. Limit switch LS-4 indicates that transfer arms 60 and 62 are in their fully extended position and limit switch LS-7 indicates that transfer arms 60 and 62 are in their fully retracted position. Limit switches LS-5 and LS-6 indicate intermediate positions for transfer arms 60 and 62 and are utilized to control the processing station, in a manner to be described hereinafter.

As shown in FIG. 3, a workpiece 120, illustratively circular and shown in phantom lines, is captured between transfer arms 60 and 62. The distance between transfer arms 60 and 62 is slightly greater than the width of the workpiece. Since the described apparatus is adapted for use with different size workpieces, transfer arms 60 and 62 must be adjustable. This adjustment takes place in the mounting of the transfer arms on the block 64, illustratively by means of elongated openings in the transfer arms through with extend bolts for connection of the transfer arms to block 64.

When transfer arms 60 and 62 are fully retracted, a cassette positioned on cassette receiving station 14 is between arms 60 and 62. During extension of transfer arms 60 and 62, arm 60 passes through the rear side of the cassette and pushes a workpiece from its slot within the cassette along guide means 16. When transfer arms 60 and 62 are fully extended and their direction of travel is reversed, arm 62 pushes the workpiece back along guide means 16 and back into the same slot in the cassette. It is noted from FIG. 1 that the frame 10 is tilted at an angle so that the guide means is inclined upwardly from the cassette receiving station. The reason for this tilting is to insure that all workpieces are completely inside the cassette so that when the cassette is indexed to its next position, there will not be any workpieces extending outside the cassette area where they may be damaged by contact with transfer arm 62.

Frame 10 is provided with a plate 130 which separates a "wet" area from a "dry" area of the apparatus. Transfer arms 60 and 62 extend through appropriate slots in plate 130, as does carriage member 76. On the "dry" side of plate 130 are provided the limit switches, the motors, and the means for moving the transfer arms and the cassette receiving station.

Control and Operation

Figure 8:
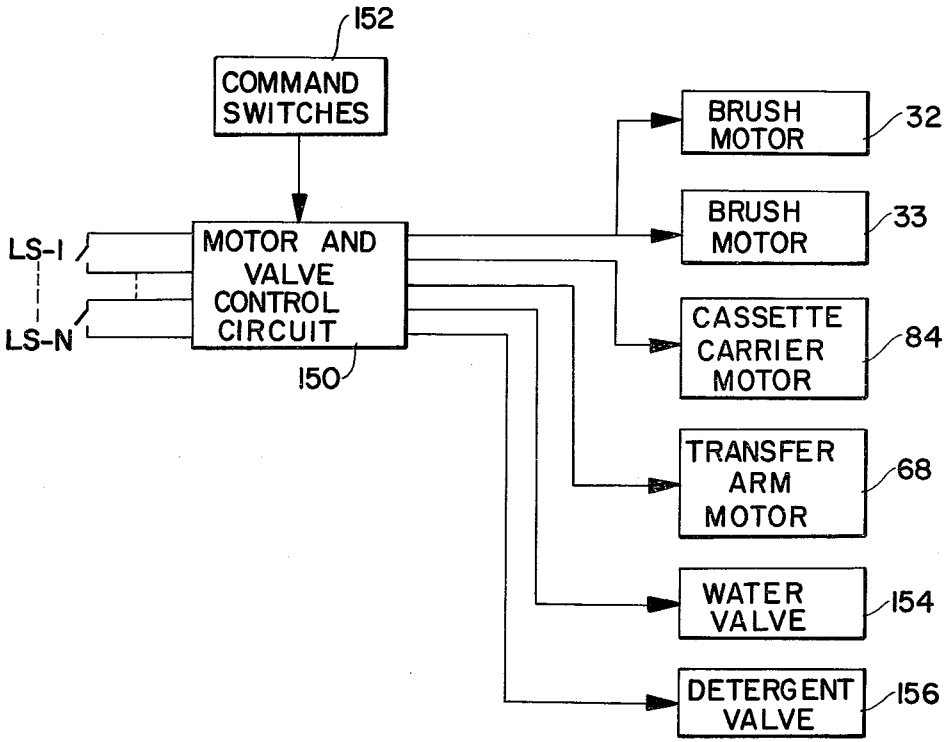
FIG. 8 depicts a block schematic diagram of illustrative control circuitry for operating the apparatus of this invention.

The aforedescribed apparatus is operated under the control of the circuitry depicted in block schematic form in FIG. 8. Motor and valve control circuit 150 senses the conditions of limit switches LS-1 through LS-N to control the operation of the various system motors and valves. Motor and valve control circuit 150 is conditioned by command switches 152 to provide the desired system operation. Circuit 150 and switches 152 are situated within housing 160, mounted on support structure 11. A control panel 162 of housing 160 contains the operative elements of command switches 152 as well as various indicators. Switches 152 include for example, a POWER ON switch, a SINGLE CYCLE switch, an AUTOMATIC switch, a CARRIER RESET switch, a STOP switch, and a START switch. The POWER ON switch is for supplying power to the apparatus. The SINGLE CYCLE switch conditions the apparatus to process a single workpiece. The AUTOMATIC switch conditions the apparatus to successively process all the workpieces in the cassette. The CARRIER RESET switch causes the cassette carrier to be moved to its home position. The STOP switch causes the apparatus to stop at whatever point it is at when the switch is operated. Finally, the START switch causes the apparatus to begin operating in the mode to which it has been previously conditioned.

The basic operation of the aforedescribed apparatus is as follows. Initially, the cassette receiving platform 72 is in its home position, as shown in FIG. 2. In this position, limit switch LS-1 is actuated by actuator 88. A cassette filled with workpieces to be processed is then placed on platform 72. Assuming that the AUTOMATIC switch is depressed, when the START switch is actuated, motor and valve control circuit 150 causes cassette carrier motor 84 to turn shaft 82 in such a direction that platform 72 is moved away from its home position, or upwardly as shown in FIG. 2. When actuator 88 operates limit switch LS-2, this indicates that the cassette on platform 72 is situated with a workpiece in its first slot being aligned with guide means 16. This workpiece is intermediate transfer arms 60 and 62, and is captured thereby. The actuation of limit switch LS-2 causes motor and valve control circuit 150 to stop cassette carrier motor 84 and to start transfer arm motor 68. Prior to this time, limit switch LS-7 had been actuated, indicating that the transfer arms had been in their fully retracted position. Motor 68 is now operated to turn shaft 66 so that transfer arms 60 and 62 start extending. Also, brush motors 32 and 33 are turned on to cause brushes 30 and 31 to turn in directions opposing the movement of the workpiece, that is, as viewed in FIG. 2, brush 30 is turned in a counter-clockwise direction and brush 31 is turned in a clockwise direction. When the actuator on block 64 operates limit switch LS-6, water valve 154 is opened to cause water to be sprayed from nozzles 24 and 25. At this time, the workpiece being processed is within guide means 16. As the leading edge of the workpiece gets in close proximity to brushes 31 and 32, the actuator on block 64 operates limit switch LS-5. At this time, detergent valve 156 is opened to cause a detergent solution to be sprayed from nozzles 34 and 35 onto brushes 30 and 31. Therefore, as the workpiece passes between brushes 30 and 31, it is scrubbed with a detergent solution. It will be recalled that as it passes the brushes, the workpiece is entirely exposed due to the discontinuity in the upper guideway 40 and the fact that an unflanged roller is in this position in the lower guideway 38. When the trailing edge of the workpiece passes the brushes 30 and 31, the acutator on block 64 operates limit switch LS-4, indicating that transfer arms 60 and 62 are fully extended. At this time, transfer arm motor 68 is reversed to cause transfer arms 60 and 62 to be retracted. Also at this time, the rotation directions of brush motors 32 and 33 are reversed to cause brushes 30 and 31 to reverse their directions of rotation, these new directions again being opposed to the direction of movement of the workpiece. Also at this time, water valve 154 and detergent valve 156 are operated to cause water to be sprayed from nozzles 34 and 35 onto brushes 30 and 31. Water is also sprayed onto the workpiece from nozzles 24 and 25. When the actuator on block 64 operates limit switch LS-5, brush motors 32 and 33 are turned off and the spray from nozzles 34 and 35 is discontinued. When the actuator on block 64 operates limit switch LS-6, the spray from nozzles 24 and 25 is dicontinued.

When transfer arms 60 and 62 are fully retracted, the workpiece is returned back into the cassette at the slot from which it had previously been removed. As mentioned above, tilting of frame 10 insures that the workpiece is fully within the cassette.

With transfer arms 60 and 62 fully retracted, limit switch LS-7 is operated by the actuator on block 64. Motor and valve control circuit 150 thereupon stops transfer arm motor 68 and starts cassette carrier motor 84. Cassette carrier motor 84 thereupon causes shaft 82 to rotate and move platform 72. As previously described, associated with carrier motor 84 is a camming arrangement in cooperation with a limit switch (not shown), which limit switch is actuated when platform 72 has moved sufficiently so that the next slot within the cassette is aligned with guide means 16. The above-described sequence of operations by which the workpieces in the cassette are processed is repeated until actuator 88 operates limit switch LS-3. This indicates that the workpiece in the last cassette slot has been processed. At this time, cassette carrier motor 84 turns shaft 82 in the reverse direction to return platform 72 to its home position where actuator 88 operates limit switch LS-1. The cassette with the processed workpieces may now be removed from platform 72 and replaced by a cassette with workpieces to be processed. The START switch may be operated to repeat the cycle for the new cassette.

Accordingly, there has been described apparatus for automatically, simultaneously cleaning both sides of a plurality of workpieces. It is understood that the above-described embodiment is merely illustrative of the application of the principles of this invention. Numerous other arrangements may be devised by those skilled in the art without departing from the spirit and scope of this invention, as defined by the appended claims.

What is claimed is:

1. Apparatus for moving a workpiece from within a cassette through a processing station and back to said cassette, said apparatus comprising:

a frame, said processing station being mounted on said frame;

a cassette receiving station mounted on said frame for receiving said cassette;

guide means extending from said cassette receiving station through said processing station for receiving an edge portion of said workpiece; and workpiece moving means for moving said workpiece from its position within said cassette along said guide means through said processing station and for moving said workpiece back through said processing station along said guide means to said cassette.

2. Apparatus according to claim 1 wherein said processing station extends on both sides of said guide means.

3. Apparatus according to claim 2 wherein said guide means is arranged so as to expose said workpiece edge portion within said processing station.

4. Apparatus according to claim 2 wherein said processing station includes:

A pair of brushes disposed one on each side of said guide means, said brushes being mounted for rotation each about an axis perpendicular to the direction of travel of the workpiece along said guide means;

means for rotating said brushes; and means for controlling said rotating means so as to cause said brushes to be rotated in such direction so that the movement of the brushes on the respective sides adjacent the guide means is opposite the direction of movement of the workpiece along the guide means.

5. Apparatus according to claim 4 further including:

means for adjusting the positions of said brushes in a direction mutually perpendicular to said axis and said guide means.

6. Apparatus according to claim 1 wherein said guide means includes a pair of spaced apart elongate members.

7. Apparatus according to claim 1 wherein said guide means includes:

an upper guideway including a pair of spaced apart members for receiving said workpiece therebetween; and a lower guideway having a plurality of roller members for supporting said workpiece.

8. Apparatus according to claim 7 further including means for adjusting the spacing between said upper guideway and said lower guideway so as to accomodate different size workpieces.

9. The apparatus according to claim 7 therein said roller members include:

a first plurality of flanged rollers each having a central cylindrical portion and a pair of outer flange portions; and a second plurality of unflanged rollers having a cylindrical portion of the same diameter as that of the flanged rollers, said flanged and unflanged rollers being positioned alternately along said lower guideway.

10. Apparatus according to claim 9 wherein said upper guideway is discontinuous within said processing station and an unflanged roller is disposed in said lower guideway within said processing station at a point corresponding to said upper guideway discontinuity so as to expose said workpiece edge portion within said processing station.

11. Apparatus according to claim 1 wherein said moving means includes:

a first transfer arm adapted to extend through said cassette and push a workpiece from said cassette along said guide means through said processing station;

a second transfer arm adapted to push said workpiece through said processing station along said guide means back into said cassette; and means for simultaneously moving said first and second transfer arms in reciprocating motion along said guide means;

said first and second transfer arms being spaced so as to capture said workpiece therebetween.

12. Apparatus according to claim 11 further including means for adjusting the spacing of said transfer arms to accomodate different size workpieces.

13. Apparatus according to claim 1 wherein said frame is tilted at an angle so that said guide means is inclined upwardly from said cassette receiving station.

14. Apparatus according to claim 1 wherein said cassette holds a plurality of workpieces within slots thereof and said cassette receiving station includes means for incrementally moving said cassette to sequentially align one at a time said slots with said guide means.

* * * * *